United States Patent [19]

Farrell

[11] Patent Number: 4,708,275

[45] Date of Patent: Nov. 24, 1987

[54] TRIM RECEIVER

[75] Inventor: John P. Farrell, Paducah, Ky.

[73] Assignee: Westvaco Corporation, New York, N.Y.

[21] Appl. No.: 888,135

[22] Filed: Jul. 23, 1986

[51] Int. Cl.[4] ..... B65H 23/00

[52] U.S. Cl. ..... 226/97

[58] Field of Search ..... 15/409; 83/98, 99, 100; 225/1, 93; 241/38, 39, 41, 42; 406/93, 94, 108, 153; 226/97

[56] References Cited

U.S. PATENT DOCUMENTS

| | | | |
|---|---|---|---|
| 3,144,216 | 8/1964 | Billingsley | 242/56.4 |
| 3,200,685 | 8/1965 | Heilbrunn | 83/98 |
| 3,216,669 | 11/1965 | Corbett | 416/190 |
| 3,252,366 | 5/1966 | Karr | 83/98 |
| 3,286,896 | 11/1966 | Kinney | 226/97 |
| 3,999,696 | 12/1976 | Reba et al. | 226/97 |
| 4,391,411 | 7/1983 | Colburn | 241/39 |
| 4,405,126 | 9/1983 | Frye et al. | 83/98 |
| 4,410,315 | 10/1983 | Frye | 83/98 |

*Primary Examiner*—Harvey C. Hornsby
*Assistant Examiner*—Corinne M. Reinckens
*Attorney, Agent, or Firm*—W. A. Marcontell; R. L. Schmalz

[57] ABSTRACT

Narrow strips of trim waste from high speed paper web converting and winding operations are drawn into a vacuum disposal system by a receiver which draws the trim strip over a flat surface aligned substantially parallel-planar with the strip off-running course. Such flat surface is flushed with an attached boundary layer of high velocity air which follows a smooth curve of the flat surface into the duct wall enclosure.

6 Claims, 3 Drawing Figures

TRIM RECEIVER

BACKGROUND OF THE INVENTION

1. Field of the Invention

The present invention relates to systems for converting web or film material dispensed from rolls. More particularly, the present invention relates to a roll trim disposal system.

2. Prior Art

In the usual case, the continuously produced web product of a papermachine is wound onto a reel that is as long as the papermachine is wide which may be 15 to 20 feet. Such massive quantities of paper are impractical for direct shipment to converters and therefore require off-machine processing to cut the web into a number of reduced width strips which are wound independently as separate shipping rolls.

To accommodate the specifications of a particular customer, the exact width dimensions of the shipping rolls do not always additively equal the papermachine web width thereby requiring the waste of a trim strip which is too narrow to wind as roll. This trim strip must be continuously removed from the work station to prevent entanglement with the shipping roll product.

Traditionally, trim strips are drawn into vacuum tubes for delivery to remote collection bins or a papermachine repulper. U.S. Pat. Nos. 3,144,216 to J. G. S. Billingsley and 3,216,699 to H. O. Corbett are representative. When a trip strip velocity exceeds 2000 feet per minute, however, such traditional trim strip disposal systems require enormous power to maintain a sufficient entrance air velocity profile. Moreover, these high velocity air streams create unacceptable levels of workplace noise.

It is, therefore, an object of the present invention to reduce the power and noise levels of a high speed trim disposal system.

Another object of the present invention is to position the structure of trim disposal entrance tube more conveniently to the web traveling plane. Another object of the present invention is to provide a more efficient and reliable trim disposal system for high speed web operations.

SUMMARY

These and other objects of the invention are accommodated by a strip disposal system receiver having a duct opening disposed substantially normal to the subject web plane. This opening is of rectangular shape and has a curved entrance surface having straight line transverse elements that are parallel with the web width or cross-machine direction. Air flow from a discharge slot is directed over the curved entrance surface width so as to attach a high velocity boundary layer of air next to the curved surface.

Below the curved surface and within the ducting, another discharge slot directs air flow over and parallel with the internal surface of a rectangular duct wall. A third discharge slot is positioned on the opposite side of the rectangular duct from the second discharge slot which also directs high velocity air flow over and parallel with the rectangular duct wall surface.

BRIEF DESCRIPTION OF THE DRAWINGS

Relative to the drawings wherein like reference characters designate like or similar elements.

DESCRIPTION OF THE PREFERRED EMBODIMENT

Figure 1:
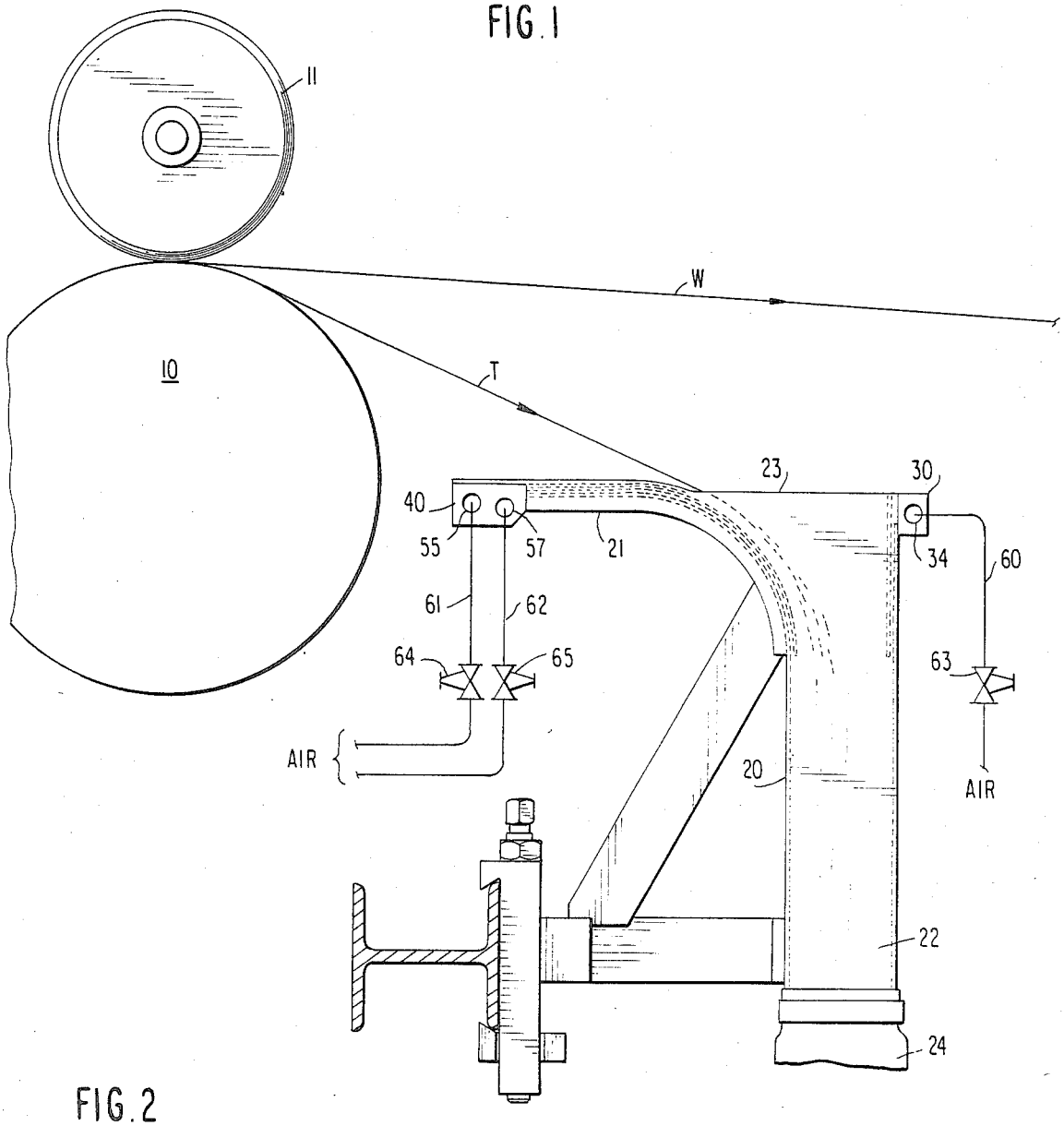
FIG. 1 is an elevational view of the invention in an operating environment.
Figure 2:
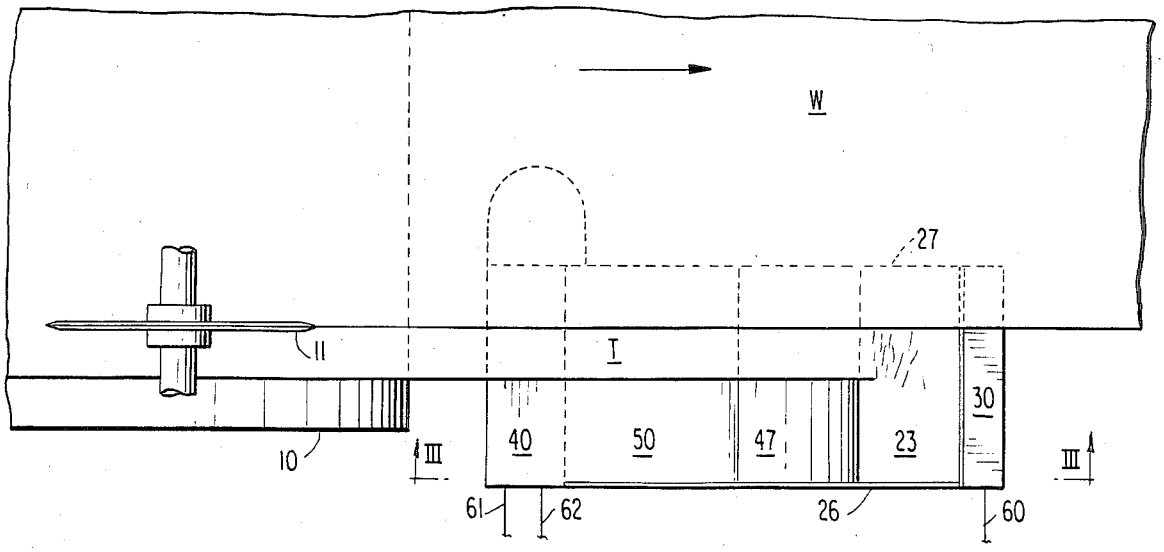
FIG. 2 is a plan view of the invention in an operating environment.

Paper web converting or rewinding machines usually provide a turning roll 10 over which the web W is drawn for slitting by rotating disc knives 11. Beneath the web W on the outrunning side of the turning roll 10 is positioned the trim receiver 20 of the present invention. In general configuration, the receiver has an inverted L-shape with the flat of the L foot 21 positioned closely to and substantially parallel with the outrunning web course.

In section, the receiver 20 is an open duct piece of flat sides and square corners. Preferably, the leg of the L-shape 22 is sectionally proportioned with the width being about twice the depth. Typical dimensions would be about 4½ inches wide and 2 inches deep. The receiver upper end 23 is open to the internal duct volume whereas the receiver lower end is connected by a transition piece 24 to a traditional ducting system.

Figure 3:
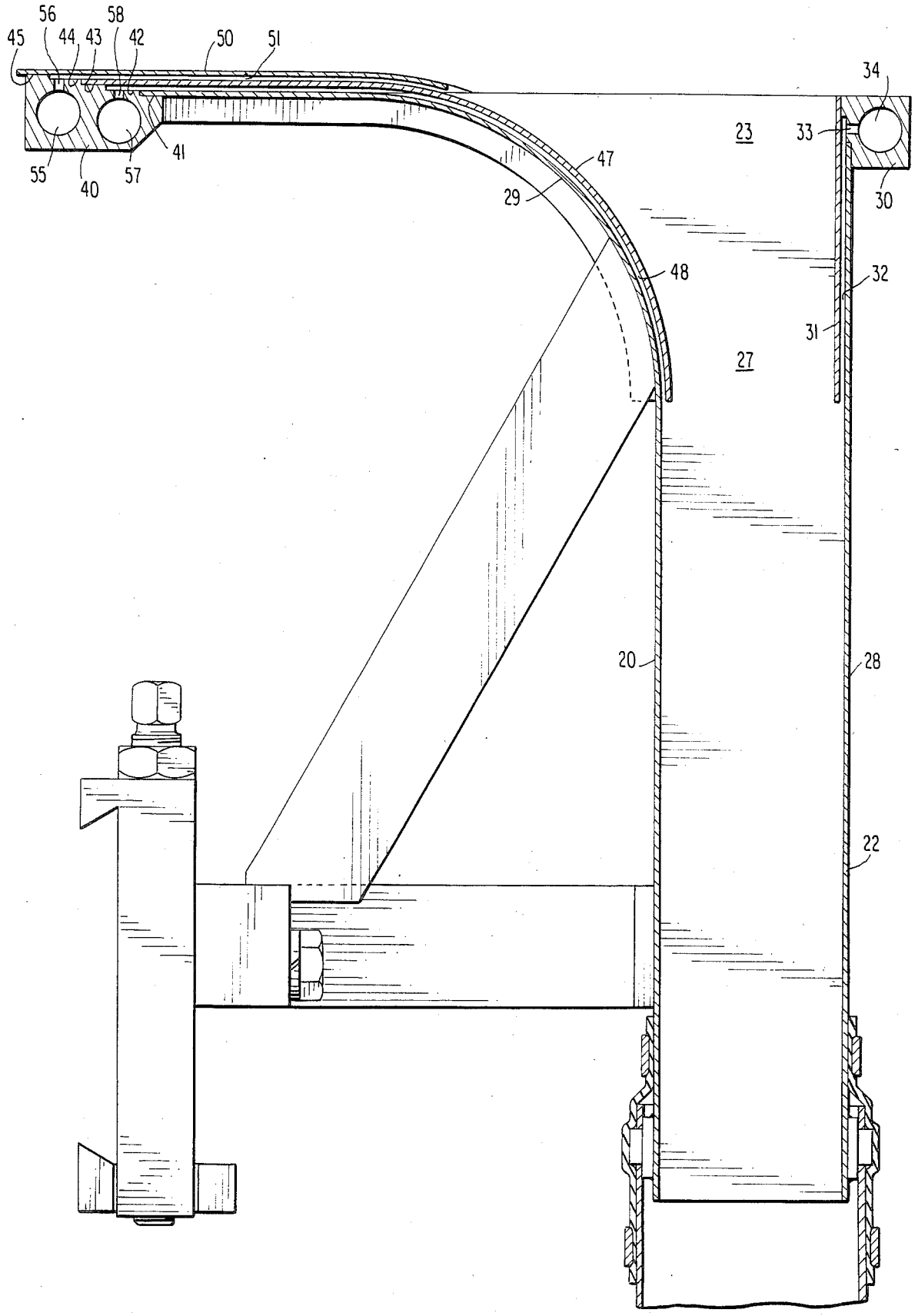
FIG. 3 is a sectional elevation of the invention viewed along the cutting plane III—III of FIG. 2.

Relating the foregoing general description to the detailed section of FIG. 3, it is seen that the outer envelope of the receiver is formed by two sheet metal lateral side pieces 26 and 27 of identical L-shape linked together by a rectangular sheet metal back side piece 28. The front side 29 is formed of sheet metal having substantially the same width as the back side piece 28 but is curved over a circular arc of 90°.

The upper end of the back side piece 28 is secured to a single channel air manifold block 30. Also secured to the back side manifold block is a sheet metal curtain piece 31 which internally parallels the back side piece 28 from the upper receiver opening down to a level opposite from the lower tangent point respective to the front side arc. Between the internal surface of the back side piece and the curtain piece 31 is an 0.048 inch gap air flow channel 32 extending across the full internal width of the receiver. A slot 33 or a series of port holes connect the manifold channel 34 with the flow channel 32.

A dual channel manifold block 40 receives the end of front side piece 29 into the lowermost of five step surfaces 41–45. Intermediate step surface 43 secures the end of a secondary curtain sheet 47 which is curved in parallel with the front side piece 29 down to the lower arc tangent point. A front side secondary air flow channel is provided in the 0.048 inch space therebetween. To the uppermost step surface 45 of the front manifold block 40 is secured a primary curtain sheet 50 which extends horizontally parallel with the upper ends of front side piece 29 and secondary curtain piece 47, respectively. Such parallelism continues beyond the upper arc tangent point and includes approximately 15° of arc formed into the discharge end. Primary air flow channel 51 is confined between the 0.048 inch gap primary curtain piece 50 and the secondary curtain piece 47.

Primary air flow channel 51 is supplied with air from the manifold channel 55 through a slot or ports 56 which open into the step space 44. Similarly, secondary air flow channel 48 is supplied with air from the manifold channel 57 through a slot or ports 58 which open into the step space 42.

Referring again to FIG. 1, the manifold channels 34, 55 and 57 are each supplied independently by air conduits 60, 61 and 62, respectively. Flow control valves 63, 64 and 65 regulate the air flow rate to each manifold channel and, hence, the exit velocity from each duct channels 32, 51 and 48, respectively.

Operationally, the air flow through the several channels is adjusted to match the trim T velocity as it advances from the turning roll 10. Relative to the primary channel 51, the objective is a boundary layer of high velocity, laminar flow layer of air attached to the surface of secondary curtain 47. Apparently, the trim strip T is caught in a high velocity shear field between the laminar discharge layer adjacent the secondary curtain 47 and slower moving, induced flow air entering the duct opening 23 from the environmental atmosphere. Turbulence within the shear field causes a severe flutter effect on the trim strip which tends to tear and shred it into small, easily conveyed bits which are further accelerated into the ducting by the high speed laminar flow from secondary channels 32 and 48.

As speculation having no limitation on the invention scope, it would appear that the invention provides a unique air flow velocity profile about the receiver rim. Whereas a traditional vacuum duct would have the highest velocity air moving through the center of the duct flow channel, the present invention assures that the highest velocity air entering the receiver is along the front wall thereof. In addition, the abrupt velocity interface between the laminar, high velocity air and the slower moving atmospheric air creates a moving shear field to seize the trim strip in a pressure differential clamp to draw the strip under tension off the turning roll 10 into the receiver duct channel.

Having fully described my invention, I claim:

1. A trim disposal duct receiver having an axially extending duct portion extending longitudinally from a planar rim perimeter, the plane of said rim perimeter being substantially perpendicular to the axis of said duct portion, a front wall of said duct having planar elements parallel with said rim plane, said front wall extending continuously from said rim along an increment that is substantially co-planar with said rim plane into a substantially 90° arc increment curved about an axis parallel with said planar elements, first wall curtain means substantially the width of said front wall being positioned parallel with said rim co-planar increment of said front wall from said rim to beyond a first point of arc tangency, a first air flow channel space between said front wall and said first wall curtain means for directing an attached boundary layer of air over said front wall, such air being directed into said channel space from a first air distribution manifold at said rim.

2. A trim disposal duct receiver as described by claim 1 wherein said first curtain wall continues over said arc into a portion of said duct proximate of a second point of arc tangency.

3. A trim disposal duct receiver as described by claim 2 wherein a second curtain wall overlays said first curtain wall from said rim to within said arc increment for confining a second air flow channel space and a second air distribution manifold along said rim for directing an air flow from said rim onto an arced portion of said first curtain wall.

4. A trim disposal duct receiver having four planar walls joined with substantially normal joint corners to form the front, back and sides of an enclosed duct channel that is open at axially opposite receiving and discharging ends thereof, terminal edges of said walls at said receiving end forming a rim plane that is substantially normal to a duct channel axis, said front wall being curved about a substantially 90° circular arc formed about an axis parallel with said rim plane, said arc being positioned intermediate of said receiving and discharging ends with an increment of said front wall continuing substantially co-planar with said rim plane from a first point of arc tangency to said rim, a first curtain wall overlaying said front wall across the width thereof to confine a first air flow channel over said co-planar increment and said arc, and first air supply means disposed along the terminal edge of said front wall to distribute a first pressurized flow of air into and across said first air flow channel for discharge along the enclosed surface of said front wall toward said discharge end.

5. A trim disposal duct receiver as described by claim 4 further comprising a second curtain wall overlaying a portion said first curtain wall across the width thereof to confine a second air flow channel over said co-planar increment, and second air supply means disposed along the terminal edges of said front wall to distribute a second pressurized flow of air into and across said second air flow channel for discharge along the arc portion of said first curtain wall.

6. A trim disposal duct receiver as described by claim 5 further comprising a third curtain wall overlying a portion of said back wall across the width thereof to confine a third air flow channel over said back wall, and third air supply means disposed along the terminal edge of said back wall to distribute a third pressurized flow of air into and across said second air flow channel for discharge along said back wall.

* * * * *